US007211952B2

(12) United States Patent
Irie et al.

(10) Patent No.: US 7,211,952 B2
(45) **Date of Patent: *May 1, 2007**

(54) GAS DISCHARGE DISPLAY DEVICE WITH PARTICULAR FILTER CHARACTERISTICS

(75) Inventors: Katsuya Irie, Kawasaki (JP); Fumihiro Namiki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 90 days.

This patent is subject to a terminal disclaimer.

(21) Appl. No.: 10/939,420

(22) Filed: Sep. 14, 2004

(65) Prior Publication Data

US 2005/0029943 A1 Feb. 10, 2005

Related U.S. Application Data

(63) Continuation-in-part of application No. 09/234,490, filed on Jan. 21, 1999, now Pat. No. 6,853,125.

(30) Foreign Application Priority Data

Jun. 18, 1998 (JP) ..... 10-171179

(51) Int. Cl.
*H01J 17/49* (2006.01)

(52) U.S. Cl. ..... 313/582; 313/584

(58) Field of Classification Search ..... 313/582–587; 315/169.4; 345/37

See application file for complete search history.

(56) References Cited

U.S. PATENT DOCUMENTS

| | | | | |
|---|---|---|---|---|
| 4,626,071 | A | 12/1986 | Wada et al. | |
| 4,803,402 | A | 2/1989 | Raber et al. | |
| 4,989,953 | A | 2/1991 | Kirschner | |
| 4,990,821 | A | 2/1991 | Blaisdell et al. | |
| 5,024,923 | A | 6/1991 | Suzuki et al. | |
| 5,667,888 | A | 9/1997 | Yoshida et al. | |
| 5,813,753 | A | 9/1998 | Vriens et al. | |
| 5,825,128 | A | 10/1998 | Betsui et al. | |
| 6,008,582 | A | 12/1999 | Asano et al. | |
| 6,034,474 | A | 3/2000 | Ueoka et al. | |
| 6,297,582 | B1 | 10/2001 | Hirota et al. | |
| 2001/0050533 | A1* | 12/2001 | Hirose | 313/583 |
| 2003/0117346 | A1* | 6/2003 | Tae et al. | 345/60 |

FOREIGN PATENT DOCUMENTS

| | | |
|---|---|---|
| EP | 0523633 A1 | 1/1993 |
| EP | 0814492 A2 | 12/1997 |
| JP | 58-153904 | 9/1983 |
| JP | 5-205643 | 8/1993 |
| JP | 08123364 | 5/1996 |
| JP | 08190869 | 7/1996 |
| JP | 9-145918 | 6/1997 |
| JP | 2000323041 | 11/2000 |
| WO | 98/23980 | 6/1998 |

* cited by examiner

*Primary Examiner*—Ashok Patel
*Assistant Examiner*—Christopher M. Raabe
(74) *Attorney, Agent, or Firm*—Staas & Halsey LLP

(57) ABSTRACT

A gas discharge display device for displaying a color image by means of red, green and blue fluorescent substances, wherein a color to be reproduced by light-emission of the red, green and blue fluorescent substances for displaying a white pixel is set to be different from a white color intended for display, and a filter is disposed on a front side of the red, green and blue fluorescent substances for approximating a display color of the white pixel to the white color intended for display.

27 Claims, 12 Drawing Sheets

3

GAS DISCHARGE DISPLAY DEVICE WITH PARTICULAR FILTER CHARACTERISTICS

This application is a Continuation of application Ser. No. 09/234,490, filed Jan. 21, 1999, now U.S. Pat. No. 6,853, 125.

CROSS-REFERENCES TO RELATED APPLICATIONS

This application is related to Japanese patent application No. HEI 10-171179 filed on Jun. 18, 1998 whose priority is claimed under 35 USC §119, the disclosure of which is incorporated herein by reference in its entirety.

BACKGROUND OF THE INVENTION

1. Field of the Invention

The present invention relates to a gas discharge display device, and more particularly to a gas discharge display device as represented by a plasma display device incorporating a PDP (Plasma Display Panel).

PDPs are becoming more and more popular as a means for television display on a large screen since their practical application to color display started. One of the problems related to image quality of PDPs is an enlargement of a reproducible color range.

2. Description of the Related Art

AC-type PDPs with a three-electrode surface-discharge structure have become commercialized as color display devices. The three-electrode AC surface-discharge PDPs have pairs of main electrodes arranged parallel to each other on individual lines (rows) of matrix display for sustaining light-emission, and address electrodes arranged one by one on individual columns. Ribs for preventing discharge interference among discharge cells are provided in a stripe pattern.

In the surface-discharge structure, fluorescent layers for color display can be provided on a substrate opposed to the substrate on which the main electrode pairs are placed, and thereby it is possible to prevent the fluorescent layers from being deteriorated by ion impact at electric discharges and to increase the life of the devices. A PDP having the fluorescent layers on a rear substrate is called a "reflection type", and the one having the fluorescent layers on a front substrate is called a "projection type". The reflection-type PDP is superior to the projection-type PDP in light-emission efficiency.

Usually, a Penning gas containing neon (Ne) mixed with a little amount (4 to 5%) of xenon (Xe) is used as a discharge gas. When electric discharge occurs among the main electrodes, the discharge gas emits an ultraviolet light, which in turn excites a fluorescent substance to emit light. Each pixel corresponds to three cells, and a display color is determined and set by controlling the amounts of light-emission of the fluorescent substances of three colors of R (red), G (green), and B (blue). Heretofore, compositions of the fluorescent substances and a ratio of light-emission intensities of the three colors have been selected so that a white display color may be obtained when the amount of light-emission of each of R, G, and B is given the same signal strength.

Here, a lot of research has been made on the composition of the discharge gas. Examples of known discharge gases include a three-component gas containing the above-mentioned Penning gas mixed with helium (He) or argon (Ar) (Ne+Xe+He, Ne+Xe+Ar), a two-component gas containing helium and xenon (He+Xe), and a three-component gas containing helium, argon, and xenon (He+Ar+Xe).

As described above, since the fluorescent substance is allowed to emit light by gas discharge in PDPs, a problem arises such that the color emitted from the discharge gas is mingled with the color emitted from the discharge gas.

FIG. 12 is a view showing an emission spectrum of a two-component gas containing neon and xenon. In FIG. 12, examples of emission peaks of R, G, and B fluorescent substances are shown by broken lines. As will be understood from FIG. 12, the emission peak of the discharge gas is located near the maximum emission peak (590 nm) of the R fluorescent substance. Therefore, the red color generated by light-emission of the discharge gas is added irrespective of the color reproduced by the fluorescent substances, whereby a reddish display will appear on the entire screen. In other words, the capability of displaying the blue and green colors will decrease. The display color of a white pixel will be a color having a lower color temperature than the color reproduced by the fluorescent substances of the three colors.

SUMMARY OF THE INVENTION

The present invention has been made in view of these circumstances and the purpose thereof is to reduce the influence of light-emission of the discharge gas and to increase the color reproducibility.

Accordingly, the present invention provides a gas discharge display device for displaying a color image by means of first, second and third fluorescent substances having different emission colors, wherein a color to be reproduced by light-emission of the first to third fluorescent substances for displaying a white pixel is set to be different from a white color intended for display, and a filter is disposed on a front side of the first to third fluorescent substances for approximating a display color of the white pixel to the white color intended for display.

In the present invention, a filter is disposed for attenuating a light emitted by a discharge gas. Also, in order to compensate for the attenuation by the filter, the white color balance of the color reproduction by the fluorescent substances is intentionally shifted from the optimal value beforehand. For example, if a discharge gas emitting a light having a spectrum shown in FIG. 12 is to be used, the influence of light-emission of the discharge gas can be reduced by employing a red-cutting filter. This is disclosed as a side effect accompanying a shield of near infrared light in Japanese Unexamined Patent Publication No. HEI 09(1997)-145918. However, by merely providing a red-cutting filter, the capability of displaying a red color will decrease because the light of a red region emitted by the fluorescent substance will also be attenuated, even though the display color of the white pixel can be shifted to a blue side on a chromaticity diagram. It is extremely difficult to selectively exclude only the color emitted by the discharge gas.

Therefore, in the present invention, the emission of light from the fluorescent substances is controlled so that the light within a wavelength region attenuated by the filter will be emitted at an intensity which is stronger by an amount attenuated by the filter. For example, if a red-cutting filter is to be provided, the amount of red light is set to be a little larger among the fluorescent substances of R, G and B. By this control, the color temperature value of the color to be reproduced by the fluorescent substances in displaying a white pixel will be lower than a color temperature value of the color (intended white color for display) which has been set as a white display color. Examples of the ways for allowing the amount of light emitted by a fluorescent substance of one color to be larger than those by the fluorescent substances of the other two colors include adoption of a material having a high luminance and increase of discharge intensity or light-emission area by changing an element structure. Element structures corresponding to the fluorescent substances of the three colors may be made different from each other to provide difference in the amount of light emission.

BRIEF DESCRIPTION OF THE DRAWINGS

The present invention will be better understood from the following detailed description of preferred embodiments of the invention, taken in conjunction with the accompanying drawings, in which.

DETAILED DESCRIPTION OF THE PREFERRED EMBODIMENTS

Figure 1:
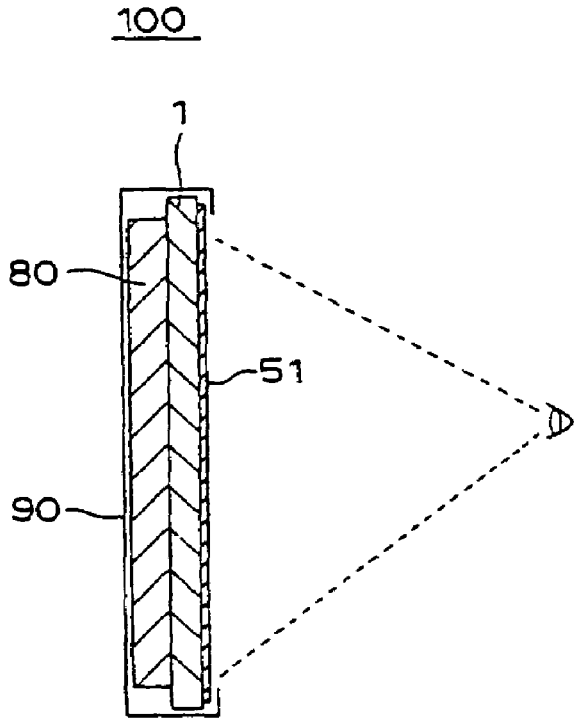
FIG. 1 is a view illustrating a construction of a plasma display device according to the present invention.

A device according to the present invention is a gas discharge display device for displaying a color image by means of first, second and third fluorescent substances having different emission colors, wherein a color to be reproduced by light-emission of the first to third fluorescent substances for displaying a white pixel is set to be different from a white color intended for display, and a filter is disposed on a front side of the first to third fluorescent substances for approximating a display color of the white pixel to the white color intended for display.

In the gas discharge display device of the present invention, a structural condition of a display element corresponding to the first fluorescent substance may be different from structural conditions of other display elements, and a light-emission intensity of the display element corresponding to the first fluorescent substance may be higher than a light-emission intensity of the display element corresponding to the first fluorescent substance which intensity is required in reproducing a white color intended for display by means of light emission of the display elements corresponding to the first to third fluorescent substances.

In the gas discharge display device of the present invention, each of the display elements may comprise a pair of electrodes for display discharge, a fluorescent substance layer that emits light by means of electric discharge between the electrodes, and dielectric substance layers that cover the respective electrodes, and the structural condition may be an area of the electrodes.

In the gas discharge display device of the present invention, the structural condition may be an area of a light-emission region of the fluorescent substance layer.

In the gas discharge display device of the present invention, the structural condition may be a thickness of the dielectric layers.

In the gas discharge display device of the present invention, a light-emission intensity of a display element corresponding to the first fluorescent substance may be higher than a light-emission intensity of the display element corresponding to the first fluorescent substance which intensity is required in reproducing a white color intended for display by means of light-emission of the display elements corresponding to the first to third fluorescent substances.

In the gas discharge display device of the present invention, the filter may have a color correction function for increasing a color temperature value.

In the gas discharge display device of the present invention, the filter may have a characteristic of attenuating an intensity of light in a red wavelength region.

In the gas discharge display device of the present invention, the filter may have a characteristic such that an average transmissivity of light in a green wavelength region is lower than an average transmissivity of light in a blue wavelength region and higher than an average transmissivity of light in a red wavelength region.

In the gas discharge display device of the present invention, the filter may have a characteristic such that a transmissivity of a shorter wavelength side of a red wavelength region is higher than a transmissivity of a longer wavelength side of the red wavelength region.

In the gas discharge display device of the present invention, the filter may have a characteristic such that a wavelength providing the lowest transmissivity has a value within a range of 560 to 610 nanometers.

In the gas discharge display device of the present invention, the filter may have a characteristic such that absorption peaks appear at least in a wavelength region of 470 to 520 nanometers and in a wavelength region of 560 to 610 nanometers.

The gas discharge display device of the present invention may comprise a substrate that constitutes a display surface with display elements, and the filter may be formed directly on the substrate.

The gas discharge display device of the present invention may comprise a display panel incorporating a discharge space therein with arranged display elements, and the filter may be fabricated separately from the display panel and disposed on a front side of the display panel.

In the gas discharge display device of the present invention, the filter may be a pigment filter.

In the gas discharge display device of the present invention, the filter may be a multi-layer film filter.

EMBODIMENTS OF THE PRESENT INVENTION

Figure 2:
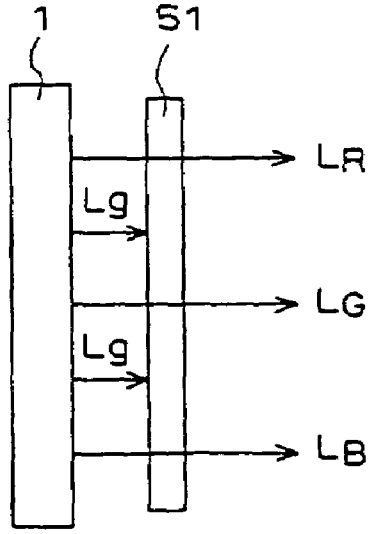
FIG. 2 is a model view illustrating a filter function.
Figure 3:
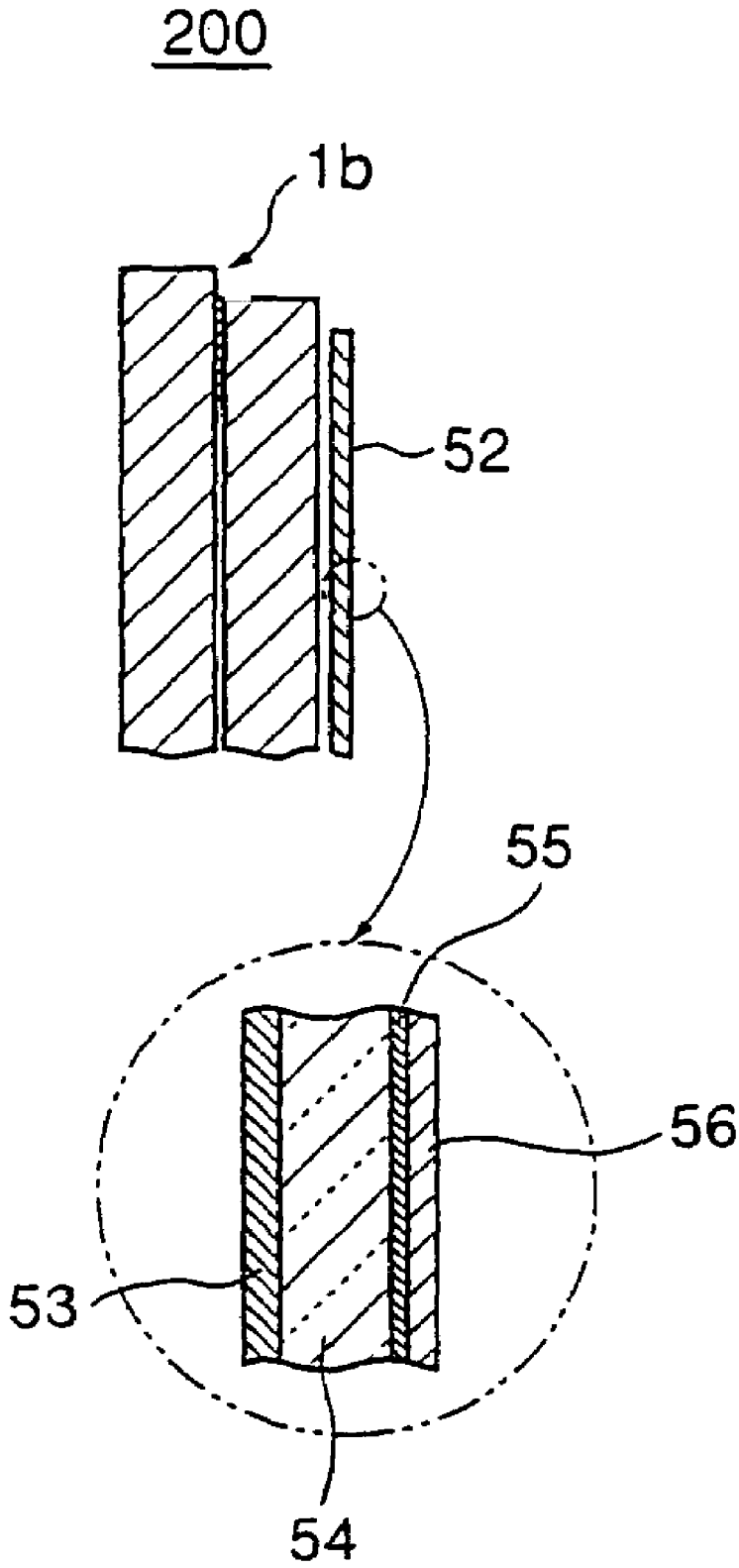
FIG. 3 is a view illustrating a construction of another plasma display device according to the present invention.

FIG. 1 is a view illustrating a construction of a plasma display device 100 according to the present invention. FIG. 2 is a model view illustrating a filter function. FIG. 3 is a view illustrating a construction of another plasma display device 200 according to the present invention.

Referring to FIG. 1, the plasma display device 100 includes a PDP 1 as a color display panel, a filter 51 formed in close contact with a front surface of the PDP 1, a driving unit 80 for activating (i.e. lighting) each cell in the PDP 1 in accordance with display contents, and an external cover 90. Referring to FIG. 2, the PDP 1 emits lights $L_R$, $L_G$, $L_B$ of three colors of R, G, B by light-emission of fluorescent substances, and a light $L_g$ by light-emission of a discharge gas. The filter 51 is designed to have a dimension extending over an entire display surface and an optical characteristic such that the filter 51 selectively attenuates the light $L_g$. Referring to FIG. 3, the plasma display device 200 includes a PDP 1*b* having the same structure as the PDP 1 and a filter 52 disposed on a front side of the PDP 1*b*. The filter 52 is fabricated separately from the PDP 1*b* and fixed to the PDP 1*b* or a frame of a device housing by means of a support (not shown). The filter 52 also has a characteristic to attenuate the light emitted by the discharge gas. A pigment filter utilizing a light absorption by a pigment, a multi-layer film filter utilizing an interference of a multi-layer film, or a different kind of filter may be used as the filter 51 and the filter 52.

Figure 4:
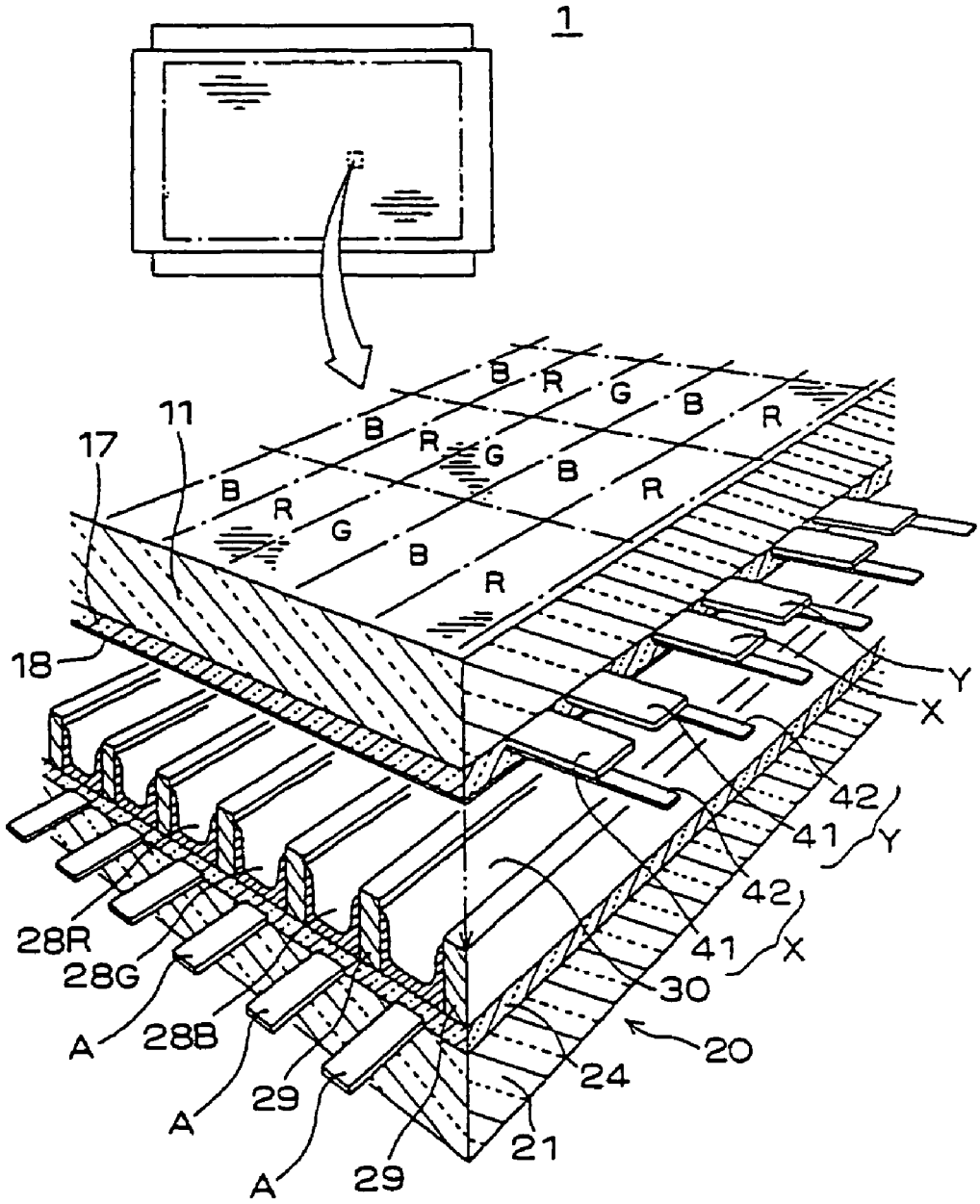
FIG. 4 is an exploded perspective view illustrating a fundamental structure inside a PDP.

FIG. 4 is an exploded perspective view illustrating a fundamental structure inside the PDP 1.

The PDP 1 is a three-electrode surface discharge PDP in which pairs of first and second main electrodes X and Y are disposed in parallel for generating an electric discharge for sustaining light-emission, and define cells (display elements) at intersections of the main electrodes X, Y with address electrodes A as third electrodes. The main electrodes X and Y extend in the direction of lines, i.e. in the horizontal direction, on the screen. The second main electrodes Y are used as scanning electrodes to select cells line by line in addressing. The address electrodes A extend in the direction of columns, i.e., in the vertical direction, and are used as data electrodes to select cells column by column in the addressing. A region on a substrate surface were the main electrodes intersect with the address electrodes is a display surface ES.

In the PDP-1, a pair of main electrodes X and Y is disposed on each line on an inside surface of a glass substrate 11 which is a base member for a front-side substrate assembly. The 10 line is a row of cells in the horizontal direction on the screen. The main electrodes X and Y each include an electrically conductive transparent film 41 and a metal film bus conductor) 42 and is covered with a dielectric layer 17 of a low melting point glass of about 30 μm thickness. A protection film 18 of magnesia (MgO) of several thousand A thickness is disposed on a surface of the dielectric layer 17. The address electrodes A are arranged on an inside surface of a glass substrate 21 which is a base member for a rear-side substrate assembly 20. The address electrodes A are covered with a dielectric layer 24 of about 30 μm thickness. On the dielectric layer 24, ribs 29 of about 150 μm height are each disposed between the address electrodes A. The ribs 29 are in the form of a linear band in a plan view. These ribs 29 partition a discharge space 30 for each sub-pixel (a unit light-emission area) in the row direction and also define a gap dimension for the discharge space 30. Fluorescent layers 28R, 28G and 28B of three colors R, G. and B for color display are formed to cover a rear-side inner surface including a portion above the address electrodes A and side walls of the ribs 29. Preferable examples of the flourescent substances are shown in Table 1.

TABLE 1

| Emission color | Fluorescent substance |
|---|---|
| R | (Y, Gd) $Bo_3$:Eu |
| G | $Zn_2SiO_4$:Mn |
| B | $BaMgAl_{10}O_{17}$:Eu |

The discharge space 30 is filled with a discharge gas containing neon as a main component with which xenon (4 to 5%) is mixed. The fluorescent layers 28R, 28G, and 28B are locally excited to emit light by ultraviolet rays radiated by xenon when an electric discharge takes place. The relative ratio of the maximum luminous intensities of R, G, and B according to the present invention is set in such a manner that the luminous intensity within the attenuated wavelength region is a little stronger in order to compensate for the attenuation caused by the filter 51 or filter 52 so as to attain the best reproducibility of white color. In other words, if the filter 51 or 52 were not provided, a color different from that of the original image would be reproduced. In the PDP 1 according to this embodiment, the relative ratio of the luminous intensities is set by selecting the materials to be used for the fluorescent layers 28R, 28G, and 28B.

One pixel for display is composed of three sub-pixels adjacently placed in the row direction and having different emission colors. A structural unit of each sub-pixel is a cell (a display element). Since the ribs 29 are arranged in a stripe pattern, portions of the discharge space 30 which correspond to the individual columns are continuous in the column direction, bridging all the lines. The gap of the electrodes between adjacent lines is set at a value which is sufficiently larger than the surface discharge gap (for example, a value within the range of 80 to 140 μm) and which can prevent charge coupling in the column direction (for example, a value within the range of 400 to 500 μm). An addressing discharge is generated between the main electrode Y and the address electrode A in a cell to be activated (in the case of a writing address form) or in a cell to be inactivated (in the case of an erasing address form) to form a charged state in which a suitable amount of wall charge is present only on cells to be activated for each line. Thereafter, an activation-sustaining voltage Vs is applied between the main electrodes X, Y to generate a surface discharge along the substrate surface in the cells to be activated.

Figure 12:
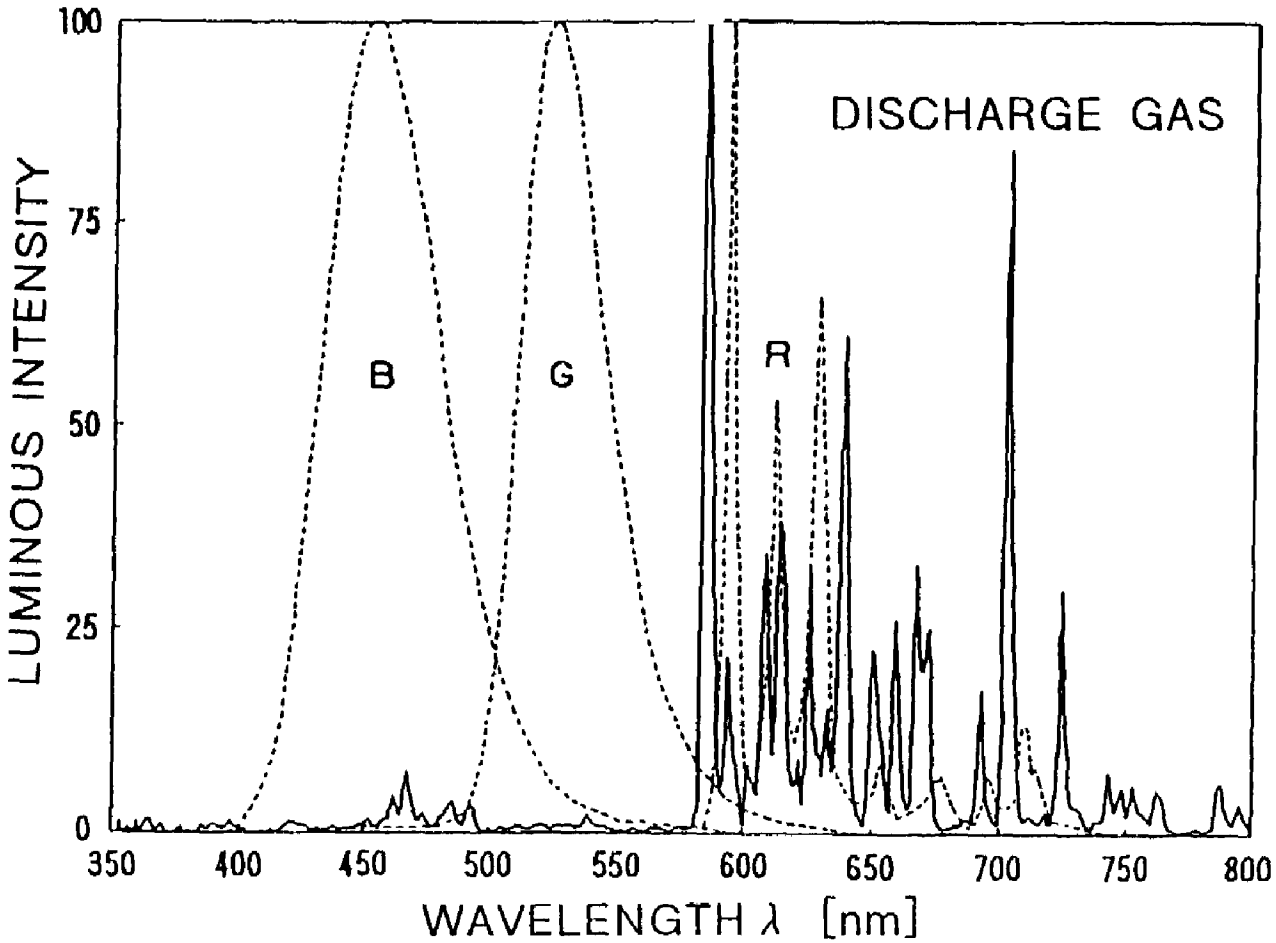
FIG. 12 is view showing an emission spectrum of two-component gas containing neon and xenon.

In the following explanation, it is assumed that a Ne—Xe (4%) Penning gas of a composition capable of light emission having a spectrum distribution shown in FIG. 12 is used as the discharge gas.

First, with reference to FIGS. 5A and 5B, an explanation will be given on a feature that the filters 51, 52 have a characteristic of attenuating an intensity of light in a red wavelength region.

Figure 5A:
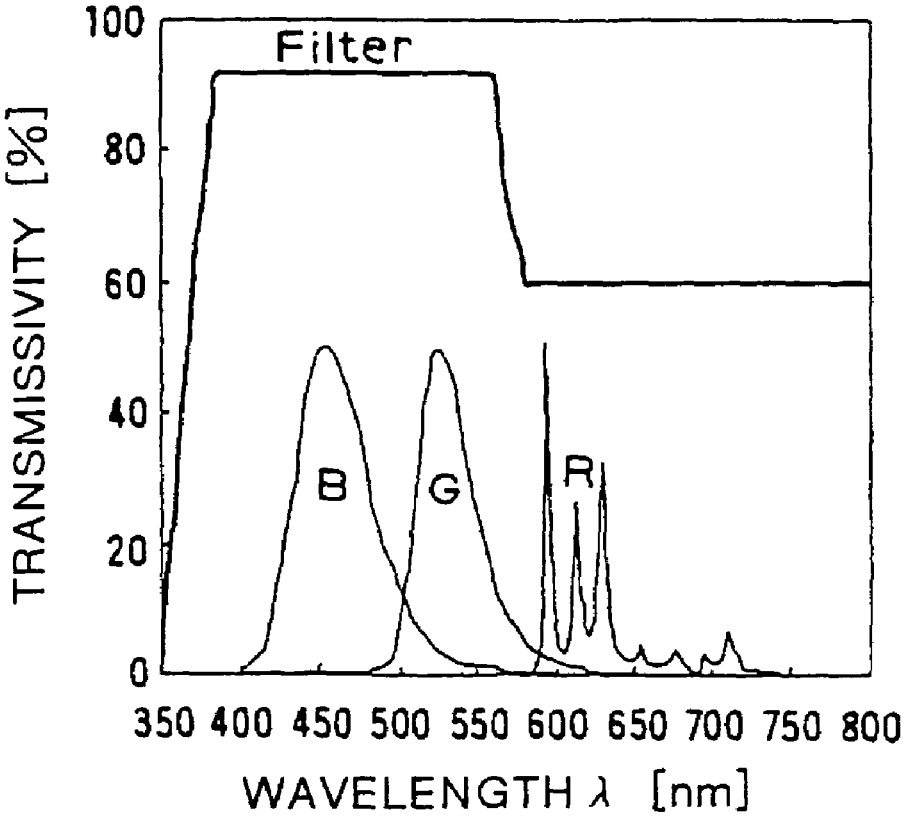
FIGS. 5A and 5B are views showing a first example of a filter characteristic and a range of color reproduction.
Figure 5B:
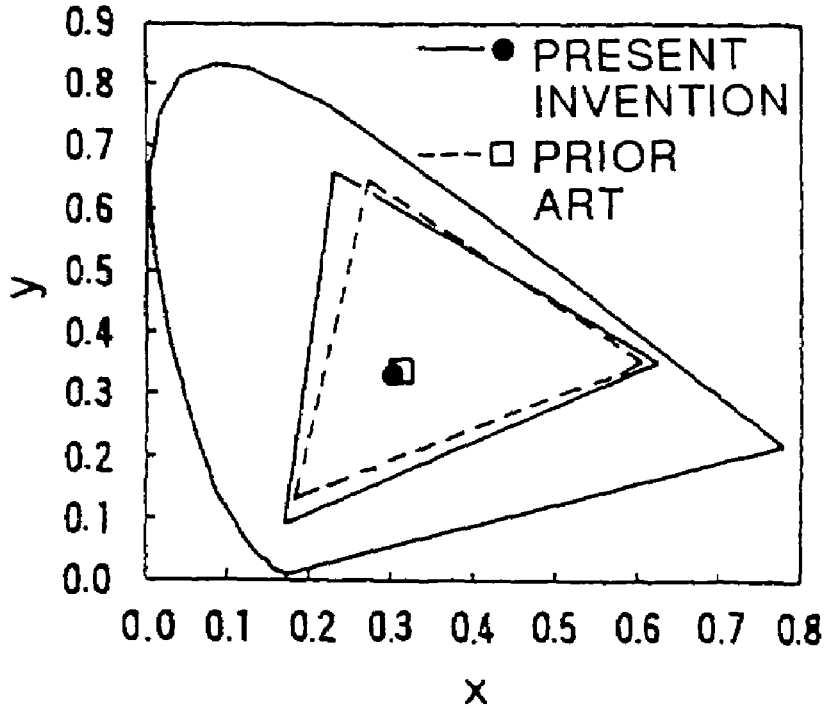

FIGS. 5A and 5B are views showing a first example of a filter characteristic and a range of color reproduction. Referring to FIG. 5A, the transmissivity characteristic of the filter 51 or the filter 52 is shown by a thick solid line and a light emission spectrum distributions of the fluorescent layers are shown by thin solid lines as a reference. FIG. 5B is a view showing a chromaticity diagram, wherein the black solid circle represents the white color displayed by application of the present invention. In FIG. 5B, the blank square represents a white color displayed according to the prior art, and the broken line shows a range of color reproduction by the prior art. The prior art as referred to herein is a technique that sets the emission luminances of the three fluorescent substances so as to obtain the best possible white color reproducibility without using a filter for color correction (the luminance ratio of G, R, B=6:3:1). The later-mentioned FIGS. 6A and 6B to 8A and 8B are drawn in the same manner as in FIGS. 5A and 5B.

The filter characteristic shown in the example of FIGS. 5A and 5B is such that the transmissivities of the visible light beams in the emission wavelength region of the R (red) fluorescent substance and in a region of emission wavelength longer than the above (i.e. the emission wavelength region of neon) are lower than the average transmissivity in the other visible light wavelength region. By intentionally increasing the light emission of the R fluorescent substance in accordance with the filter characteristic to secure a sufficient amount of light in the red wavelength region to reproduce the red color, it is possible to realize a display which is excellent in color purities of R, G, B with increased color reproducibility as compared with the prior art and in which the chromaticity of the white color display has a value desirable as an image display means, as shown in FIG. 5B. The chromaticity of each color in FIG. 5B is shown in Table 2 together with that of the prior art.

TABLE 2

| | White | | Red | | Green | | Blue | |
|---|---|---|---|---|---|---|---|---|
| | x | y | x | y | x | y | x | y |
| Present invention | 0.30 | 0.33 | 0.62 | 0.36 | 0.23 | 0.66 | 0.17 | 0.09 |
| Prior art | 0.31 | 0.34 | 0.60 | 0.35 | 0.27 | 0.65 | 0.18 | 0.13 |

Next, with reference to FIGS. 6A and 6B, an explanation will be given on a feature that the filters 51, 52 have a characteristic such that an average transmissivity of light in a green wavelength region is lower than an average transmissivity of light in a blue wavelength region and higher than an average transmissivity of light in a red wavelength region.

Figure 6A:
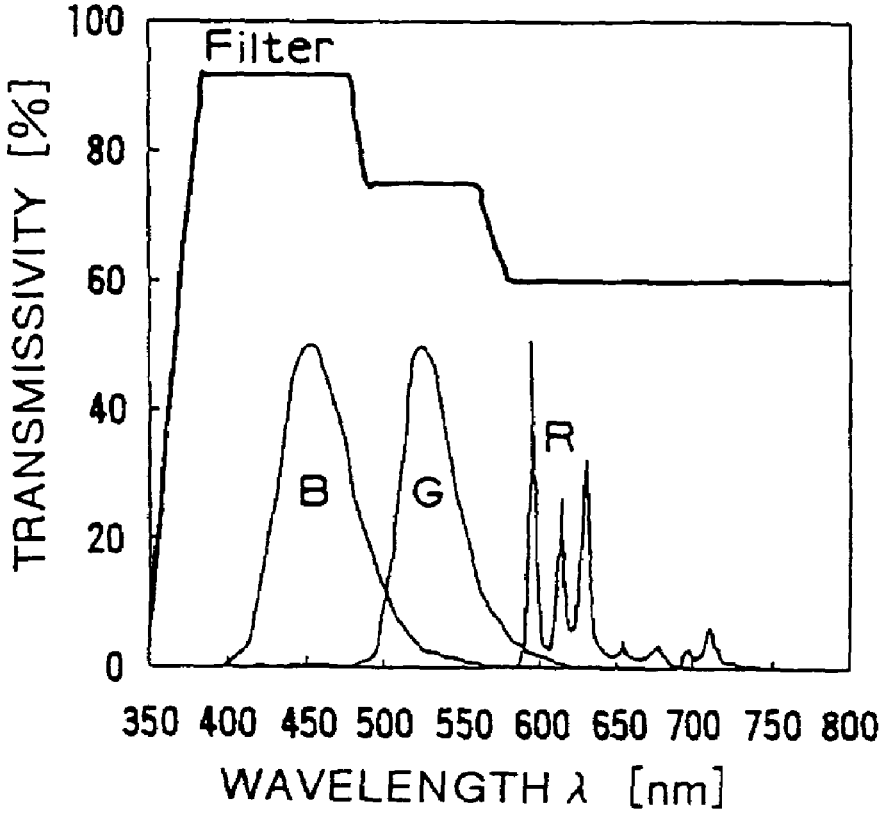
FIGS. 6A and 6B are views showing a second example of a filter characteristic and a range of color reproduction.
Figure 6B:
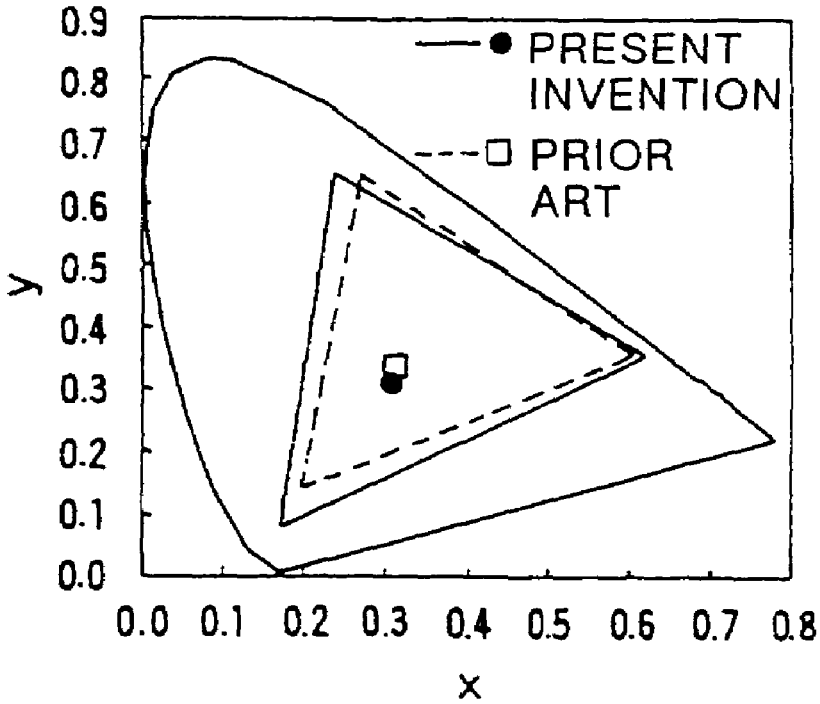

FIGS. 6A and 6B are views showing a second example of a filter characteristic and a range of color reproduction.

The filter characteristic shown in the example of FIGS. 6A and 6B is such that the transmissivity of visible light beams in the red wavelength region is the same as that shown in FIGS. 5A and 5B, and the average transmissivity of visible light beams in the wavelength region of the G fluorescent substance is lower than the average transmissivity of visible light beams in the wavelength region of the B fluorescent substance and is higher than the average transmissivity of visible light beams in the wavelength region of the R fluorescent substance. This may optimize the chromaticity of the white color display and the color temperature value to a greater degree than the example shown in FIGS. 5A and 5B. The chromaticity of each color in FIG. 6B is shown in Table 3 together with that of the prior art.

TABLE 3

| | White | | Red | | Green | | Blue | |
|---|---|---|---|---|---|---|---|---|
| | x | y | x | y | x | y | x | y |
| Present invention | 0.31 | 0.31 | 0.62 | 0.35 | 0.24 | 0.65 | 0.17 | 0.08 |
| Prior art | 0.31 | 0.34 | 0.60 | 0.35 | 0.27 | 0.65 | 0.18 | 0.13 |

Next, with reference to FIGS. 7A, 7B and FIGS. 8A, 8B, an explanation will be given on a feature that the filters 51, 52 have a characteristic such that a transmissivity of a longer wavelength side of a red wavelength region is higher than a transmissivity of a shorter wavelength side of the red wavelength region. Especially, in FIGS. 7A, 7B, an explanation will be given on a feature that the filters 51, 52 have a characteristic such that a wavelength providing the lowest transmissivity has a value within a range of 560 to 610 nanometers; and in FIGS. 8A, 8B, an explanation will be given on a feature that the filters 51, 52 have a characteristic such that absorption peaks appear at least in a wavelength region of 470 to 520 nanometers and in a wavelength region of 560 to 610 nanometers.

Figure 7A:
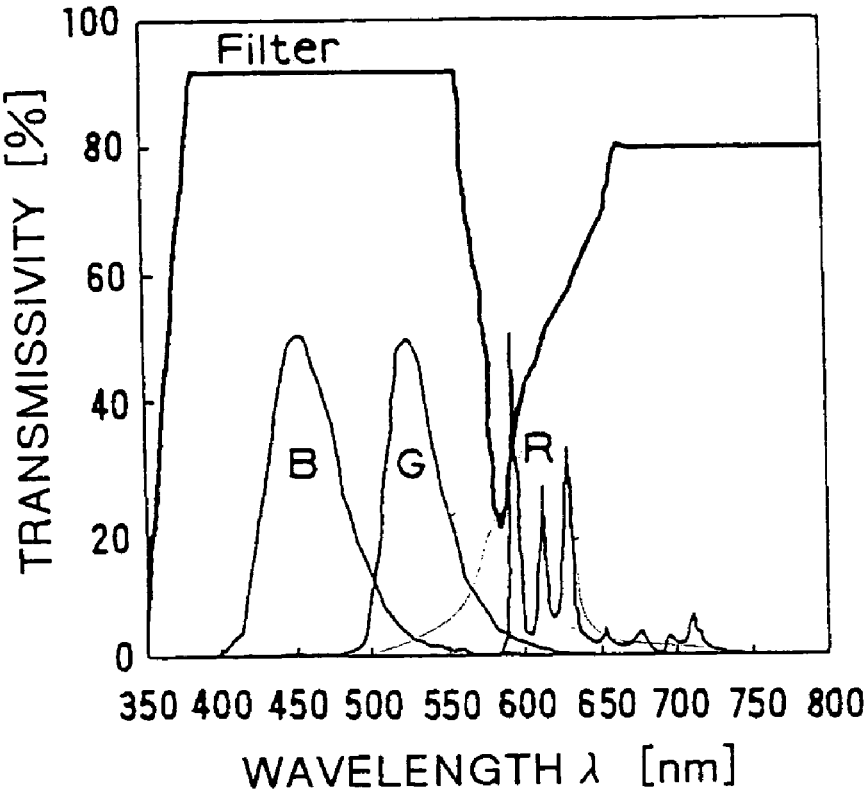
FIGS. 7A and 7B are views showing a third example of a filter characteristic and a range of color reproduction.
Figure 7B:
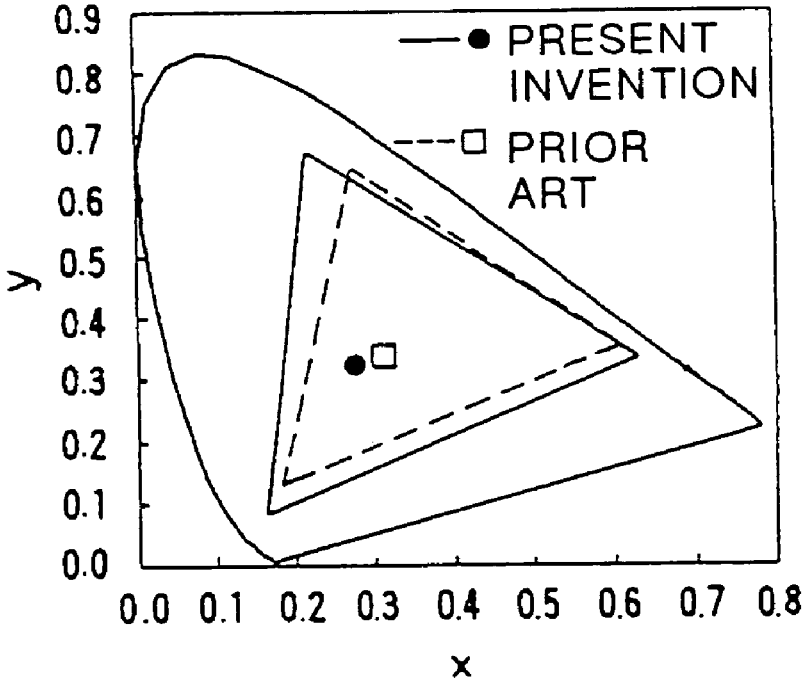

FIGS. 7A and 7B are views showing a third example of a filter characteristic and a range of color reproduction.

The filter characteristic shown in the example of FIGS. 7A and 7B is such that the filter shows an absorption peak within a region of 560 to 610 nm at which the emission peak of the discharge gas appears, thereby to efficiently remove the color emitted by the discharge gas. Also, the filter has a characteristic such that the transmissivity of a longer wavelength side of the red wavelength region of the R fluorescent substance is higher than the transmissivity of a shorter wavelength side of the red wavelength region. This provides an effect that the light beams which are emitted by the R fluorescent substance and which does not overlap with the emission peak of the discharge gas can be effectively utilized for displaying, thereby improving the capability of expressing the red color. The chromaticity of each color in FIG. 7B is shown in Table 4 together with that of the prior art.

TABLE 4

| | White | | Red | | Green | | Blue | |
|---|---|---|---|---|---|---|---|---|
| | x | y | x | y | x | y | x | y |
| Present invention | 0.27 | 0.32 | 0.63 | 0.34 | 0.21 | 0.67 | 0.16 | 0.08 |
| Prior art | 0.31 | 0.34 | 0.60 | 0.35 | 0.27 | 0.65 | 0.18 | 0.13 |

Figure 8A:
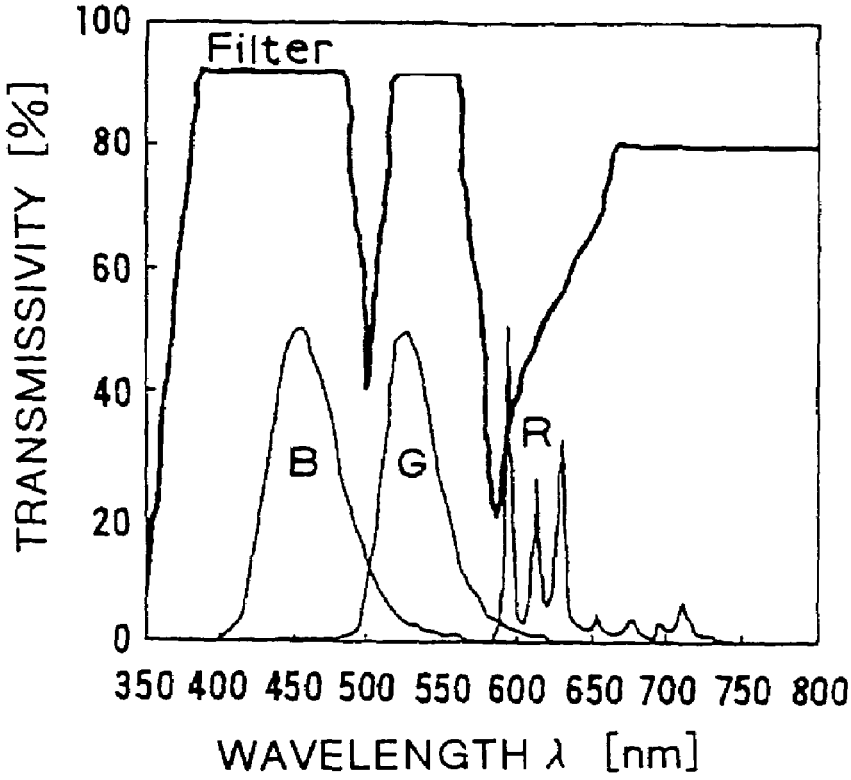
FIGS. 8A and 8B are views showing a fourth example of a filter characteristic and a range of color reproduction.
Figure 8B:
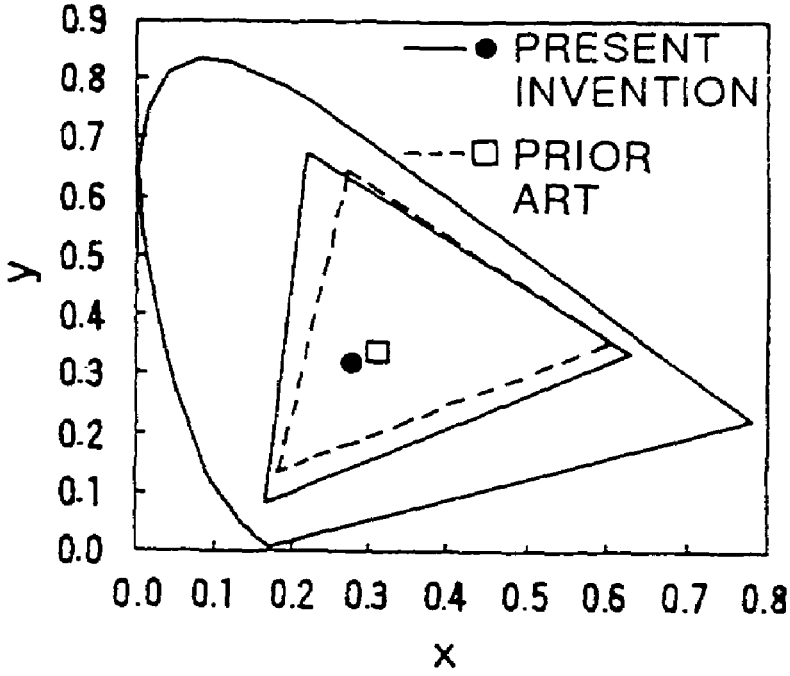

FIGS. 8A and 8B are views showing a fourth example of a filter characteristic and a range of color reproduction.

The filter characteristic shown in the example of FIGS. 8A and 8B is such that the transmissivity of visible light beams in the red wavelength region is the same as that shown in FIGS. 7A and 7B, and the filter shows an absorption peak in a wavelength region of 470 to 520 nanometers so as to clearly separate the emission of B color from the emission of G color. This may realize a display with excellent color purities of G and B in addition to an improvement in the reproducibility of white color. The chromaticity of each color in FIG. 8B is shown in Table 5 together with that of the prior art.

TABLE 5

| | White | | Red | | Green | | Blue | |
|---|---|---|---|---|---|---|---|---|
| | x | y | x | y | x | y | x | y |
| Present invention | 0.28 | 0.32 | 0.63 | 0.34 | 0.22 | 0.67 | 0.16 | 0.08 |
| Prior art | 0.31 | 0.34 | 0.60 | 0.35 | 0.27 | 0.65 | 0.18 | 0.13 |

In adopting any of the above-mentioned characteristics, it is required that the filter 51, 52 is disposed on the front side of the discharge space 30. However, there may be various choices in the form of disposing the filters. Although it is possible to dispose the filter 51, 52 on the inside of the glass substrate 11 of the PDP 1, it is preferable to dispose the filter 51, 52 on the outside of the glass substrate 11 from the view point of selection of the materials and the manufacturing steps. The filter 51, 52 may be formed either directly on the outer surface of the glass substrate 11 or on a protection plate (reinforced glass or acrylic resin plate) disposed on the front side of the glass substrate 11 through the intermediary of an air layer (gap) having a thickness of about 1.5 to 6 mm for shutting off heat generated from the PDP. If a layer having the above-mentioned characteristics is to be formed to fabricate the filter 51, 52 with a base material different from that of the glass substrate 11 or the protection plate, the base material may be a glass, an acrylic resin, a polycarbonate resin, a polymer film, or the like. From a practical point of view, the filter 51, 52 is preferably a film-like filter. For example, a desired transmissivity characteristic may be made by dispersing a suitable pigment on a surface of a polymer film and pasting the obtained film-like filter on the glass substrate 11 or the protection film. In FIG. 3 as described above, the portion encircled by a chain line shows an example in which the film-like filter 53 is pasted on the inner surface of the protection plate 54 made of reinforced glass or acrylic resin plate. In this example, an electromagnetic shielding film 55 and a light-reflection preventive film 56 are further laminated in this order on the outer surface of the protection plate. The pigment that attenuates the light in the emission wavelength region of the discharge gas may be, for example, 1-ethyl-4-[(1-ethyl-4(1H)-quinolinylidene)methyl]quinolinium iodide having an absorption maximum at 590 nm (Product No. NK-6 manufactured by Nippon Kanko Shikiso Kenkyuosho Co., Ltd. in Japan), or 3-ethyl-2-[3-(1-ethyl-4(1H)-quinolinylidene)-1-propenyl]benzoxazolium iodide having an absorption maximum at 594 nm (Product No. NK-741 manufactured by Nippon Kanko Shikiso Kenkyuosho Co., Ltd.). The desired characteristics may be obtained by adjusting the amounts of these pigments and other pigments to be added. If a multi-layer film is to be used as the filter 51, 52, the layers of the multi-layer film may be laminated by means of a thin film formation technique such as vapor deposition, sputtering, CVD, or the like.

In the PDP 1 of the above-mentioned embodiment, the emission of light in a wavelength region which is to be attenuated by the filter is increased (intensified) by selecting a material for the fluorescent substances while maintaining the cell structures for the R, G, and B colors to be the same. In the following embodiments, the ratio of the emission intensities of the R, G, and B colors is set by allowing the cells to have different cell structures.

Next, with reference to FIG. 9, an explanation will be given on a feature that the area of the electrodes in the red display element is larger than an area of the electrodes in the red display element which area is required in reproducing the white color intended for display.

Figure 9:
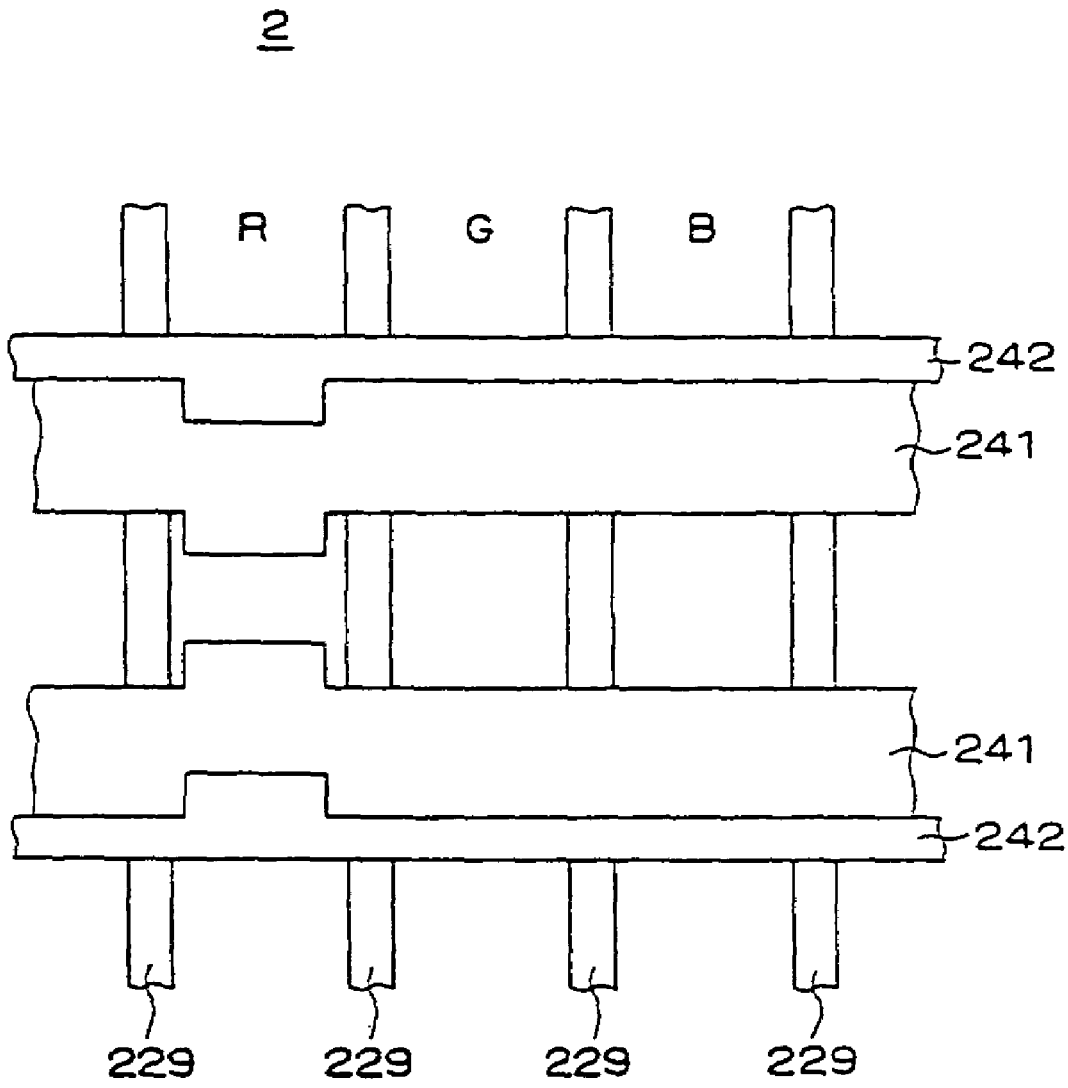
FIG. 9 is a plan view illustrating an electrode structure of a PDP according to a second embodiment of the present invention.

FIG. 9 is a plan view illustrating an electrode structure of a PDP 2 according to a second embodiment of the present invention.

The PDP 2 also has a three-electrode surface-discharge structure and its basic construction is the same as that of the PDP 1. A fluorescent layer (not shown) is disposed between adjacent ribs 229 arranged in a stripe-like pattern. Three consecutive cells arranged in parallel in the direction of arranging the ribs (i.e. in the row direction) constitute one pixel. In the PDP 2, the electrically-conductive transparent film 241 and the metal film 242, which constitute the main electrodes, do not have uniform widths. Namely, the electrically conductive transparent film 241 above the R cells protrudes into the surface discharge gap and, in accordance therewith, the metal film 242 is formed to have a locally wider portion, as shown in FIG. 9. This structure allows the R cells to have a larger electrode area than the G cells or the B cells, whereby the discharge intensity of the R cells in this embodiment is increased as compared with the R cells of the prior art in which the luminance ratio of R, G, and B is set to be a value (3:6:1) for reproducing the white color of intended display. The same effect may also be obtained by allowing only the electrically conductive transparent film 241 to have a locally wider portion.

Figure 10:
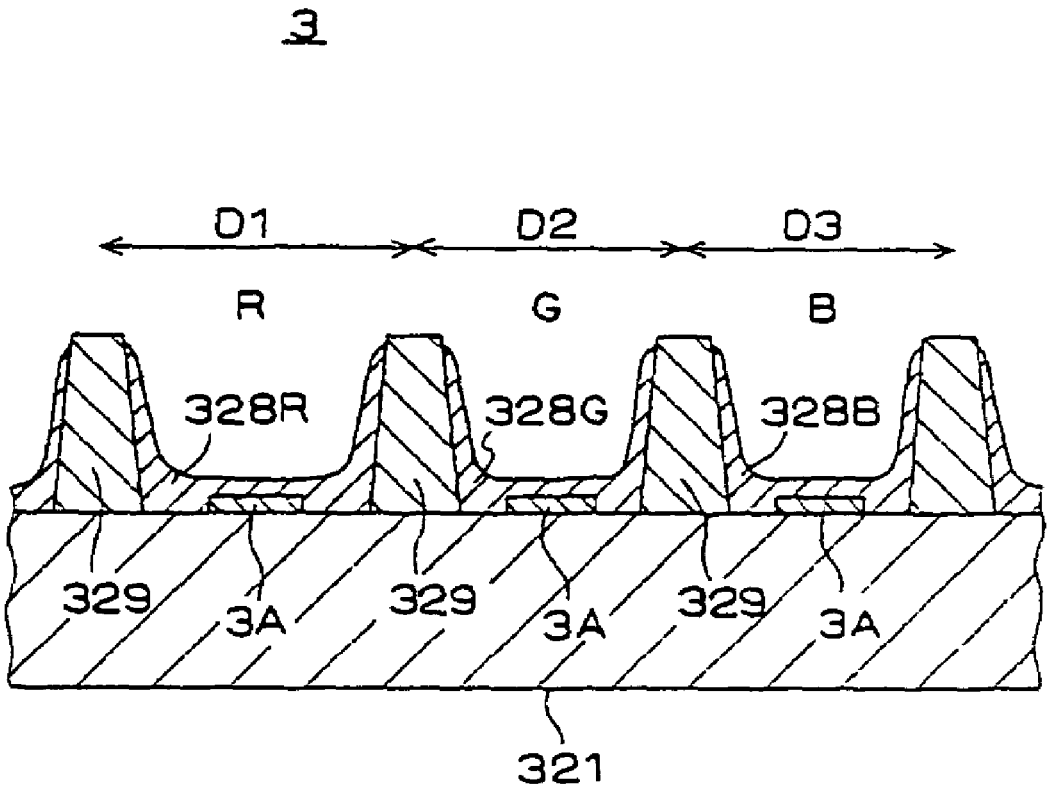
FIG. 10 is a cross-sectional view illustrating an essential part of a PDP according to a third embodiment of the present invention.

Next, with reference to FIG. 10, an explanation will be given on a feature that the area of the light-emission region of the fluorescent substance layer in the red display element is larger than an area of the light-emission region of the fluorescent substance layer in the red display element which area is required in reproducing the white color intended for display FIG. 10 is a cross-sectional view illustrating an essential part of a PDP 3 according to a third embodiment of the present invention.

Address electrodes 3 A and ribs 329 are arranged on a glass substrate 321 located on the rear side of the PDP 3, and fluorescent layers 328R, 328G, and 328B are formed between the ribs 329. In the PDP 3, the dimension D1 of the R cells in the line direction is longer than the each of the dimensions D2, D3 of the G cells and the B cells in the line direction. In other words, the emission area for the R color is larger than each of the emission areas for the G color and the B color to allow the R cells of this embodiment to generate a stronger discharge than the R cells of the prior art.

Figure 11:
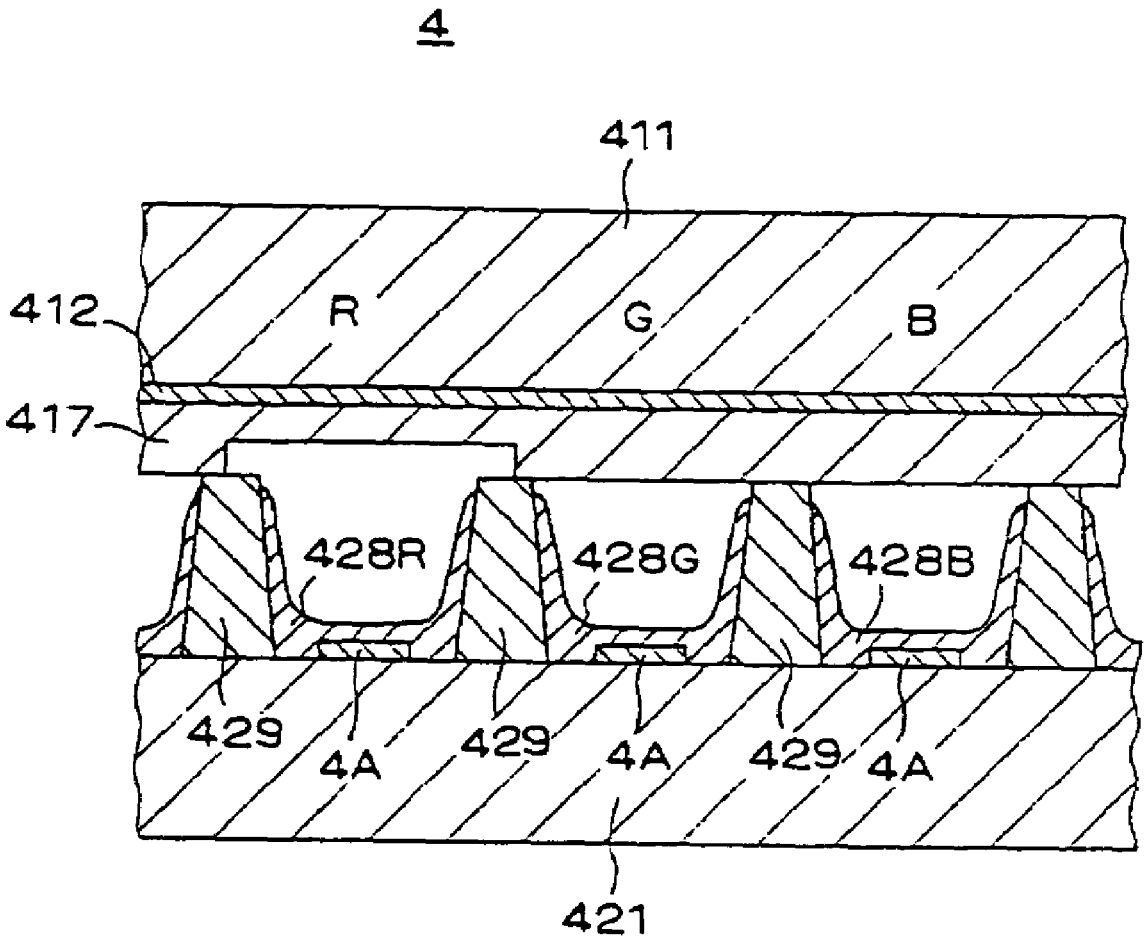
FIG. 11 is a cross-sectional view illustrating an essential part of a PDP according to a fourth embodiment of the present invention.

Next, with reference to FIG. 11, an explanation will be given on a feature that the thickness of the dielectric substance layers covering the electrodes in the red display element is smaller than a thickness of the dielectric substance layers covering the electrodes in the red display element which thickness is required in reproducing the white color intended for display FIG. 11 is a cross-sectional view illustrating an essential part of a PDP 4 according to a fourth embodiment of the present invention.

Main electrodes 412 and a dielectric layer 417 are disposed on an inner surface of a glass substrate 411 located on the front side of the PDP 4. Address electrodes 4A and ribs 429 are arranged on a glass substrate 421 located on the rear side of the PDP 4, and fluorescent layers 428R, 428G, and 428B are formed between the ribs 429. In the PDP 4, the dielectric layer 417 above the R cells has a smaller thickness than the dielectric layer 417 above the G cells or the B cells, whereby the discharge intensity of the R cells in this embodiment is increased as compared with the R cells of the prior art.

Figure 13:
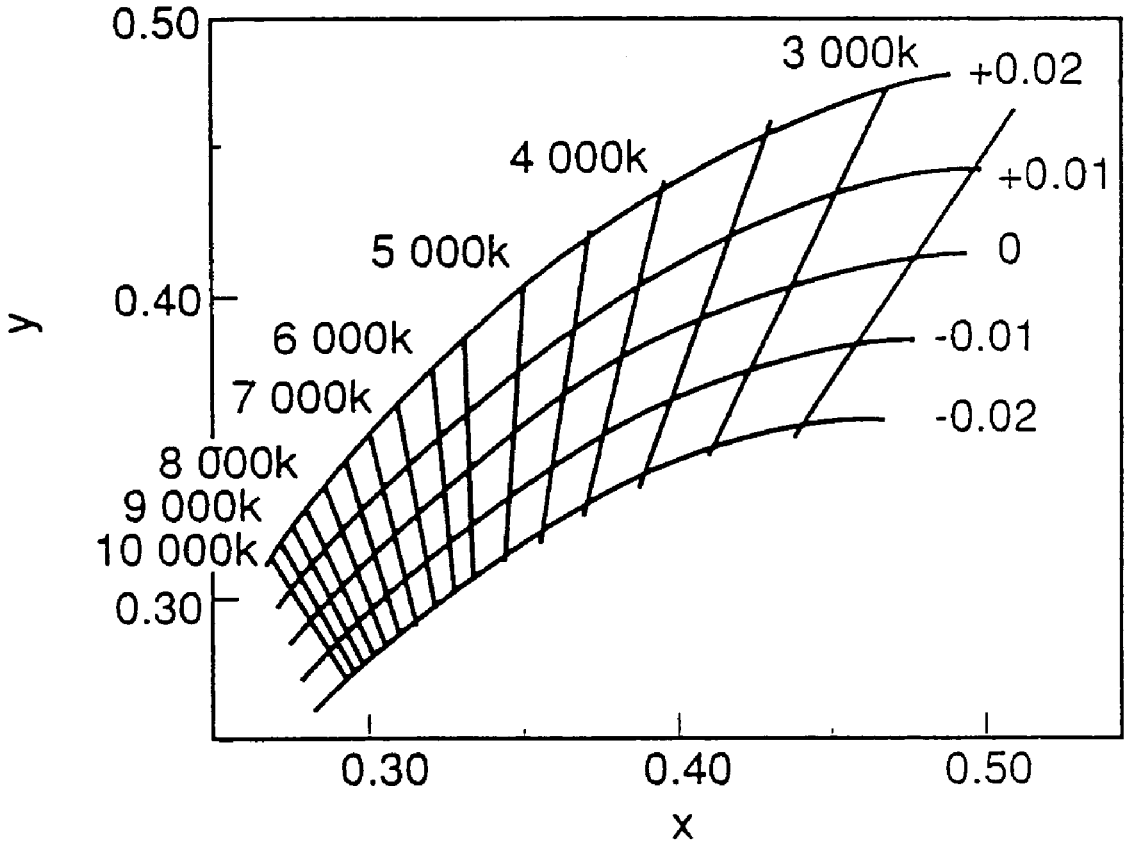
FIG. 13 is a view showing equi-color-temperature lines and equi-deviation lines on an x-y chromaticity diagram.

Hereto, the color temperature characteristic which has been described up to now is added. To increase the color temperature value, which is the feature of the present invention, is to set the chromaticity of white color to have coordinate values with higher color temperature on a color temperature curve chart as shown in FIG. 13. FIG. 13 is cited from "Television Technology Handbook", Video Information Media Society ed., 1998, p. 20, and shows equi-color-temperature lines and equi-deviation lines on an x-y chromaticity diagram. In the present invention, it is preferable that a color temperature to be reproduced by light-emission of the first to third fluorescent substances for displaying white pixel is set to be about 1000K lower than the color temperature of white color intended for display to cut the color emitted from the discharge gas effectively. Here, it is known that the preferable color temperature value varies in accordance with the system requirements or the region in which the device is used. For instance, in Japan, people prefer a color temperature value of about 9000K. However, the value of about 6000K is preferred in Europe and the United States of America. In the present invention, it is possible to obtain a preferable color temperature value which complies with each of the system requirements or the region in which the device is used, by combining the emission luminance rate of the three fluorescent substances and the transmissivity characteristic of the filter.

Here, if a discharge gas other than the Ne—Xe Penning gas is to be used, the filter characteristic may be set so that the color emitted by the discharge gas is removed and the emission intensity of the light in the wavelength region which is attenuated by the filter is increased. Also, the filter for removing the color emitted by the discharge gas may be combined with individual built-in R, G, B filters that are disposed for improving the color purity in each of R, G, and B cells. Further, the emission intensity of the R color may be increased by varying the voltages supplied to the electrodes instead of varying the cell structures as mentioned above. The present invention can also be applied to a display using a gas discharge device other than the PDP.

As shown and described above, the present invention can reduce the influence of light-emission by discharge gas and increase the color reproducibility.

Although the present invention has fully been described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A gas discharge display device using a plasma display panel, comprising:

a plurality of discharge cells formed within a discharge space between a front substrate and a rear substrate, each of the discharge cells including a discharge gas therein and being provided with one of fluorescent substances of red, green and blue selected to emit light for performing color display, whereby at least some of the plurality of discharge cells are provided with the red fluorescent substance, at least some of the plurality of discharge cells are provided with the blue fluorescent substance, and at least some of the plurality of discharge cells are provided with the green fluorescent substance; and a filter disposed apart from the front substrate, the filter having a characteristic of attenuating light within a wave range of visible light emitted by the discharge gas, wherein a light-emission intensity of at least one of the fluorescent substances of red, green and blue is set to be larger than would be necessary to display an intended white color by simultaneous unfiltered light emission of the fluorescent substances of red, green and blue, so that light within the wave range is emitted with intensity to compensate for attenuation of light within the wave range attenuated by the filter.

2. The gas discharge display device of claim 1, wherein the at least one of the fluorescent substances with the larger than necessary intensity comprises the red fluorescent substance.

3. The gas discharge display device of claim 2, wherein each of the discharge cells further comprises a pair of electrodes for generating electric discharge between the electrodes to allow the fluorescent substances to emit light, and where each of the discharge cells having the red fluorescent substance has a surface area of its electrodes larger than a surface area of the electrodes of the discharge cells having the blue and green fluorescent substances.

4. The gas discharge display device of claim 2, wherein each of the discharge cells further comprises a light-emission region and an area of the same, and where the discharge cells having the red fluorescent substance have areas larger than the areas of the discharge cells having the blue and green fluorescent substances.

5. The gas discharge display device of claim 2, wherein each of the discharge cells further comprises a pair of electrodes for generating electric discharge between the electrodes to allow the fluorescent substances to emit light, where a dielectric substance layer covers each pair of electrodes, and where each of the discharge cells having the red fluorescent substance has a thickness of the dielectric substance layer that is smaller than a thickness of the discharge cells having the blue and green fluorescent substances.

6. The gas discharge display device of claim 2, wherein the filter has a color correction function of increasing a color temperature value of light received by the filter.

7. The gas discharge display device of claim 2, wherein the filter has a characteristic of attenuating an intensity of received light in a red wavelength region.

8. The gas discharge display device of claim 2, wherein the filter has a characteristic such that an average transmissivity of light in a green wavelength region is lower than an average transmissivity of light in a blue wavelength region and is higher than an average transmissivity of light in a red wavelength region.

9. The gas discharge display device of claim 2, wherein the filter has a characteristic such that a transmissivity of a longer wavelength side of a received red wavelength region is higher than a transmissivity of a shorter wavelength side of the received red wavelength region.

10. The gas discharge display device of claim 2, wherein the filter has a characteristic such that a wavelength of lowest transmissivity of the filter has a value within a range of 560 to 610 nanometers.

11. The gas discharge display device of claim 2, wherein the filter has a characteristic such that absorption peaks appear at least in a wavelength region of 470 to 520 nanometers and in a wavelength region of 560 to 610 nanometers.

12. The gas discharge display device of any of claims 6–11, wherein the gas discharge display device further comprises a pair of substrates for forming a discharge space therebetween, and the filter is formed directly on an inner or outer surface of one of the substrates that constitutes a display surface of the display device.

13. The gas discharge display device of any of claims 6–11, wherein the gas discharge display device further comprises a display panel incorporating a discharge space therein with arranged display elements, and the filter is fabricated separately from the display panel and disposed apart from a front side of the display panel.

14. The gas discharge display device of claim 1, wherein the gas discharge display device further comprises a display panel incorporating a discharge space therein with arranged display elements and a transparent protection plate for protecting a display surface of the display panel, and the filter is disposed on an inner or outer surface of the protection plate.

15. The gas discharge display device of claim 12, wherein the filter comprises a pigment filter.

16. The gas discharge display device of claim 12, wherein the filter comprises a multi-layer film filter.

17. The gas discharge display device of claim 1, wherein the red fluorescent substance comprises a fluorescent substance composed of (Y, Gd) $BO_3$:Eu, the green fluorescent substance comprises a fluorescent substance composed of $Zn_2SiO_4$:Mn, and the blue fluorescent substance comprises a fluorescent substance composed of $BaMgAl_{10}O_{17}$:Eu.

18. The gas discharge display device of claim 1, wherein the discharge gas comprises a Penning gas composed of neon and xenon.

19. A gas discharge display device using a plasma display panel according to claim 1, wherein the filter comprises a single continuous filter.

20. A gas discharge display device using a plasma display panel according to claim 1, wherein the filter is disposed on a front side of the front substrate.

21. A gas discharge display device using a plasma display panel, comprising:

a plurality of discharge cells formed within a discharge space between a front substrate and a rear substrate, each of the discharge cells including a discharge gas therein and being provided with one of fluorescent substances of red, green and blue selected to emit light for performing color display, whereby at least some of the plurality of discharge cells are provided with the red fluorescent substance, at least some of the plurality of discharge cells are provided with the blue fluorescent substance, and at least some of the plurality of discharge cells are provided with the green fluorescent substance; and a filter disposed apart from the front substrate, the filter having a characteristic of attenuating light within a wave range of visible light emitted by the discharge gas, wherein a light-emission intensity of at least one of the fluorescent substances of red, green and blue is set to be larger than would be necessary to display an intended white color by simultaneous unfiltered light emission of the fluorescent substances of red, green and blue, so that light within the wave range is emitted with intensity to compensate for attenuation of light within the wave range attenuated by the filter, wherein the at least one of the fluorescent substances with the larger than necessary intensity comprises the red fluorescent substance, and wherein the filter has a characteristic such that a wavelength of lowest transmissivity of the filter has a value within a range of 560 to 610 nanometers.

22. A gas discharge display device according to claim 21, wherein the filter comprises a single continuous filter.

23. A gas discharge display device according to claim 21, wherein the filter is disposed apart from a front side of the front substrate.

24. A gas discharge display device according to claim 21, wherein the filter has a color correction function of increasing a color temperature value of light received by the filter.

25. A gas discharge display device according to claim 21, wherein the gas discharge display device further comprises a display panel incorporating a discharge space therein with arranged display elements and a transparent protection plate for protecting a display surface of the display panel, and the filter is disposed on an inner or outer surface of the protection plate.

26. The gas discharge display device of claim 14, wherein the filter comprises a pigment filter.

27. The gas discharge display device of claim 14, wherein the filter comprises a multi-layer film filter.

* * * * *

UNITED STATES PATENT AND TRADEMARK OFFICE

CERTIFICATE OF CORRECTION

PATENT NO. : 7,211,952 B2
APPLICATION NO. : 10/939420
DATED : May 1, 2007
INVENTOR(S) : Katsuya Irie et al.

It is certified that error appears in the above-identified patent and that said Letters Patent is hereby corrected as shown below:

Cover page, col. 1,
Related U.S. Application Data
(63) Delete "Continuation-in-part" and insert --Continuation-- therefor.

Signed and Sealed this

Eighteenth Day of September, 2007

JON W. DUDAS
*Director of the United States Patent and Trademark Office*